US007150602B2

(12) United States Patent
Choi et al.

(10) Patent No.: US 7,150,602 B2
(45) Date of Patent: Dec. 19, 2006

(54) VARIABLE CAPACITY ROTARY COMPRESSOR

(75) Inventors: Jin Kyu Choi, Suwon (KR); Jun Young Lee, Yongin (KR); Dong Lyoul Shin, Suwon (KR); Seung Kap Lee, Suwon (KR); Cheol Woo Kim, Seongnam (KR); Valery Krasnoslobodtsev, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 265 days.

(21) Appl. No.: 10/815,661

(22) Filed: Apr. 2, 2004

(65) Prior Publication Data

US 2005/0002815 A1 Jan. 6, 2005

(30) Foreign Application Priority Data

Jul. 2, 2003 (KR) ..... 10-2003-0044559

(51) Int. Cl.
*F04B 49/00* (2006.01)

(52) U.S. Cl. ..... 417/218; 417/221; 417/223; 417/287; 417/410.3; 418/29; 418/60

(58) Field of Classification Search ..... 418/23, 418/29, 60, 69; 417/218, 221, 223, 287, 417/410.3

See application file for complete search history.

(56) References Cited

U.S. PATENT DOCUMENTS 713,301 A * 11/1902 Hagerty ..... 418/105
1,789,842 A * 1/1931 Rolaff ..... 418/63
5,871,342 A 2/1999 Harte et al.
6,099,259 A * 8/2000 Monk et al. ..... 417/221
6,860,724 B1 * 3/2005 Cho et al. ..... 417/223

FOREIGN PATENT DOCUMENTS

JP 62070686 A * 4/1987 ..... 418/60
JP 62078499 A * 4/1987 ..... 418/63

* cited by examiner

*Primary Examiner*—Theresa Trieu
(74) *Attorney, Agent, or Firm*—Staas & Halsey LLP

(57) ABSTRACT

A variable capacity rotary compressor including first and second compression chambers having different capacities, and a rotating shaft. First and second eccentric cams are mounted to the rotating shaft to be eccentric in a same direction. First and second eccentric bushes are fitted over the first and second eccentric cams to make an angle between eccentric lines of the first and second eccentric bushes be less than 180°. A locking pin functions to change a position of the first or second eccentric bush to a maximum eccentric position. Further, a slot is formed on the rotating shaft between the first and second eccentric bushes. In this case, the slot having a predetermined length is formed to have a same angle as the angle between the eccentric lines of the first and second eccentric bushes. The locking pin is inserted into the slot.

21 Claims, 6 Drawing Sheets

VARIABLE CAPACITY ROTARY COMPRESSOR

CROSS-REFERENCE TO RELATED APPLICATIONS

This application claims the benefit of Korean Application No. 2003-44559, filed Jul. 2, 2003, in the Korean Intellectual Property Office, the disclosure of which is incorporated herein by reference.

BACKGROUND OF THE INVENTION

1. Field of the Invention

The present invention relates, in general, to rotary compressors and, more particularly, to a variable capacity rotary compressor, which is designed such that a compression operation is executed in either of two compression chambers having different capacities, by an eccentric unit mounted to a rotating shaft.

2. Description of the Related Art

Generally, a compressor is installed in a refrigeration system, such as an air conditioner and a refrigerator, which cools air in a given space using a refrigeration cycle. In the refrigeration system, the compressor compresses a refrigerant which circulates through a refrigeration circuit. A cooling capacity of the refrigeration system is determined according to a compression capacity of the compressor. Thus, when the compressor is designed to vary a compression capacity thereof as desired, the refrigeration system is operated under an optimum condition considering several factors, such as a difference between a practical temperature and a predetermined temperature to allow air in a given space to be efficiently cooled, and to save energy.

A variety of compressors are used in the refrigeration system. The compressors are typically classified into two types, that is, rotary compressors and reciprocating compressors. The present invention relates to the rotary compressor, which will be described as follows.

The conventional rotary compressor includes a hermetic casing, with a stat or and a rotor being installed in the hermetic casing. A rotating shaft penetrates through the rotor. An eccentric cam is integrally provided on an outer surface of the rotating shaft. A roller is provided in a compression chamber to be fitted over the eccentric cam.

The conventional rotary compressor is operated as follows. As the rotating shaft rotates, the eccentric cam and the roller execute eccentric rotation in the compression chamber. A gas refrigerant is drawn into the compression chamber, compressed, and then discharged as the compressed refrigerant to an outside of the hermetic casing.

However, the conventional rotary compressor has a problem in that the conventional rotary compressor has a fixed compression capacity. Therefore, varying the compression capacity, according to a difference between an environmental temperature and a preset reference temperature, is very difficult.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, since changing the capacity of the rotary compressor according to the difference between the environmental temperature and the preset reference temperature is very difficult, the conventional rotary compressor does not efficiently cope with a variance in temperature, thus leading to a waste of energy.

SUMMARY OF THE INVENTION

Accordingly, an aspect of the present invention provides a rotary compressor which is constructed so that a compression operation is executed in either of two compression chambers, having different capacities, by an eccentric unit mounted to a rotating shaft, thus varying a compression capacity as desired.

Another aspect of the present invention provides a variable capacity rotary compressor, which is designed to prevent an eccentric bush from being rotated at a faster speed than a rotating shaft at a specific range, due to variance in pressure of a compression chamber as the rotating shaft is rotated.

The above and/or other aspects are achieved by providing a variable capacity rotary compressor, including first and second compression chambers, a rotating shaft, first and second eccentric cams, first and second eccentric bushes, and a locking pin. The first and second compression chambers have different capacities. The rotating shaft passes through the first and second compression chambers. The first and second eccentric cams are eccentrically mounted to the rotating shaft to be placed in the first and second compression chambers, respectively. The first and second eccentric bushes are fitted over the first and second eccentric cams, respectively, to cause an eccentric line of the first eccentric bush to cross an eccentric line of the second eccentric bush. The locking pin functions to change a position of the first or second eccentric bush to a maximum eccentric position, according to a rotating direction of the rotating shaft.

An angle between a maximum eccentric part of the first eccentric bush and a maximum eccentric part of the second eccentric bush is less than 180° in a rotating direction of the first or second eccentric bush which executes a compression operation.

The locking pin is positioned between the first and second eccentric cams which are eccentric in a same direction. The first and second eccentric bushes are integrated with each other by a connecting part which connects the first and second eccentric bushes to each other. A slot of a predetermined length is formed around the connecting part, and the locking pin comes into contact with a first end or a second end of the slot while the rotating shaft is rotated as the locking pin is inserted into the slot, thus causing the first and second eccentric bushes to be rotated as the position of either of the first and second eccentric bushes is changed to the maximum eccentric position with respect to the rotating shaft.

The locking pin includes a threaded shank, and a head having a larger diameter than the shank and formed at an end of the shank. The head is projected from the rotating shaft in a radial direction, when the shank of the locking pin is inserted into a hole which is formed on the rotating shaft at a position which is spaced apart from a maximum eccentric part of each of the first and second eccentric cams, at about 90°.

Further, the slot has an arc shape with an angle of less than 180° formed between a line extending from the first end of the slot to a center of the rotating shaft and a line extending from the second end of the slot to the center of the rotating shaft.

Further, the first end of the slot is positioned following the maximum eccentric part of the upper eccentric bush to be spaced apart from the maximum eccentric part of the first eccentric bush at about 90° when the rotating shaft is rotated in a first direction. The second end of the slot is positioned leading the maximum eccentric part of the second eccentric bush to be spaced apart from the maximum eccentric part of the second eccentric bush at about 90° when the rotating shaft is rotated in a second direction. Therefore, when the rotating shaft is rotated in the first or second direction with the locking pin coming into contact with the first end or the second end of the slot and the eccentric lines of the first and second eccentric bushes crossing each other, the position of the first or second eccentric bush is changed to the maximum eccentric position.

When the rotating shaft is rotated in the first direction to cause the locking pin to be in contact with the first end of the slot, a position of the maximum eccentric part of the first eccentric bush is changed to the maximum eccentric position where the maximum eccentric part of the first eccentric bush corresponds to the maximum eccentric part of the first eccentric cam, thus causing a compression operation to be executed in the first compression chamber. A position of the maximum eccentric part of the second eccentric bush is changed to a minimum eccentric position where the maximum eccentric part of the second eccentric bush is adjacent to a minimum eccentric part of the first eccentric cam, thus causing a compression operation to be rarely executed in the second compression chamber.

When the maximum eccentric part of the first eccentric bush passes an outlet port of the first compression chamber, a rotating resistance acts on the second eccentric bush in a direction opposite to a rotating direction of the rotating shaft due to a difference in pressure between an inside portion of the second compression chamber, where the eccentric line of the second eccentric bush extends 180° or less relative to the eccentric line of the first eccentric bush, and an outside portion of the second compression chamber opposite to the inside portion, thus preventing the first eccentric bush from being rotated at a speed faster than the rotating shaft, therefore preventing the first eccentric bush from slipping.

On the contrary, when the rotating shaft is rotated in the second direction to cause the locking pin to be in contact with the second end of the slot, a position of the maximum eccentric part of the second eccentric bush is changed to the maximum eccentric position where the maximum eccentric part of the second eccentric bush corresponds to a maximum eccentric part of the second eccentric cam, thus causing a compression operation to be executed in the second compression chamber. A position of the maximum eccentric part of the first eccentric bush is changed to a minimum eccentric position where the maximum eccentric part of the first eccentric bush is adjacent to a minimum eccentric part of the first eccentric cam, thus causing a compression operation to be rarely executed in the first compression chamber.

Furthermore, when the maximum eccentric part of the second eccentric bush passes an outlet port of the second compression chamber, a rotating resistance acts on the first eccentric bush in a direction opposite to a rotating direction of the rotating shaft due to a difference in pressure between an inside portion of the first compression chamber, where the eccentric line of the first eccentric bush extends 180° or less relative to the eccentric line of the second eccentric bush, and an outside portion of the first compression chamber opposite to the inside portion, thus preventing the second eccentric bush from being rotated at a speed faster than the rotating shaft, therefore preventing the second eccentric bush from slipping.

Additional and/or aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE EMBODIMENTS

Figure 1:
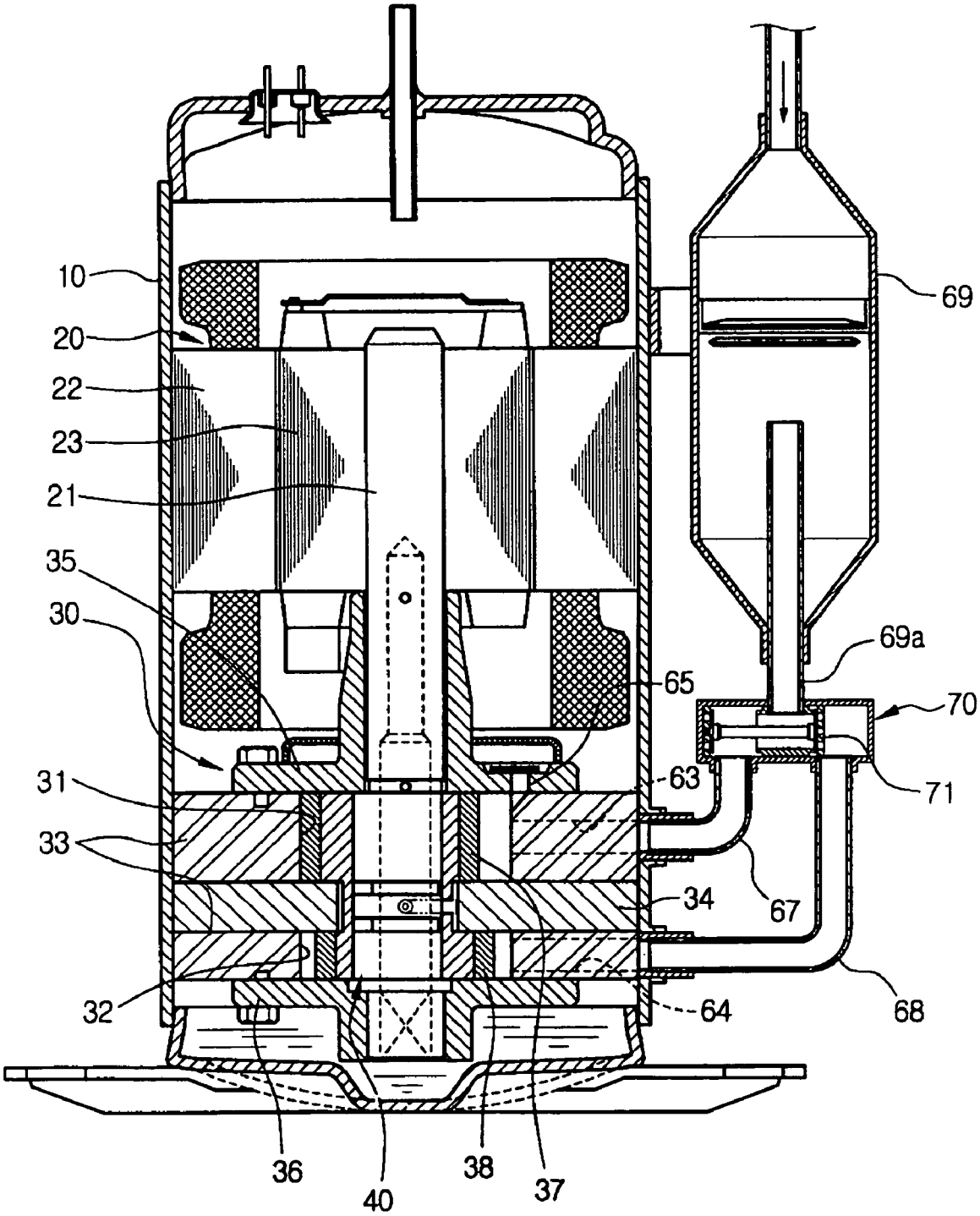
FIG. 1 is a sectional view illustrating an interior construction of a variable capacity rotary compressor, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a sectional view showing a variable capacity rotary compressor, according to an embodiment of the present invention. As illustrated in FIG. 1, the variable capacity rotary compressor includes a hermetic casing 10, with a drive unit 20 and a compressing unit 30 being installed in the hermetic casing 10. The drive unit 20 generates rotating force, and the compressing unit 30 compresses gas using the rotating force of the drive unit 20. The drive unit 20 includes a cylindrical stat or 22, a rotor 23, and a rotating shaft 21. The stat or 22 is fixedly mounted to an inner surface of the hermetic casing 10. The rotor 23 is rotatably installed in the stat or 22. The rotating shaft 21 is installed to pass through a center of the rotor 23, and is rotated along with the rotor 23 in one of a first direction which is counterclockwise in the drawings and in a second direction which is clockwise in the drawings.

The compressing unit 30 includes a housing 33, first and second flanges 35 and 36, and a partition plate 34. The housing 33 defines first and second compression chambers 31 and 32, which are both cylindrical but have different capacities, therein. The first and second flanges 35 and 36 are mounted to first and second ends of the housing 33, respectively, to rotatably support the rotating shaft 21. The partition plate 34 is interposed between the first and second compression chambers 31 and 32 to partition the first and second compression chambers 31 and 32 into each other.

In an embodiment of the invention, the first compression chamber 31 is higher than the second compression chamber 32 in terms of height, thus the first compression chamber 31 has a larger capacity than the second compression chamber 32. Therefore, a larger amount of gas is compressed in the first compression chamber 31 in comparison with the second compression chamber 32, thus allowing the rotary compressor to have a variable capacity.

Meanwhile, when the second compression chamber 32 is higher than the first compression chamber 31 in terms of height, the second compression chamber 32 has a larger capacity than the first compression chamber 31, thus allowing a larger amount of gas to be compressed in the second compression chamber 32.

Further, an eccentric unit 40 is positioned in the first and second compression chambers 31 and 32 to execute a compressing operation in either of the first and second compression chambers 31 and 32, according to a rotating direction of the rotating shaft 21. The construction and operation of the eccentric unit 40 will be described later herein, with reference to FIGS. 2 to 6.

First and second rollers 37 and 38 are placed in the first and second compression chambers 31, respectively, to be rotatably fitted over the eccentric unit 40. Inlet and outlet ports 63 and 65 (see, FIG. 3) are formed at predetermined positions of the housing 33 to communicate with the first compression chamber 31. Second inlet and outlet ports 64 and 66 (see, FIG. 5) are formed at predetermined positions of the housing 33 to communicate with the second compression chamber 32.

Figure 3:
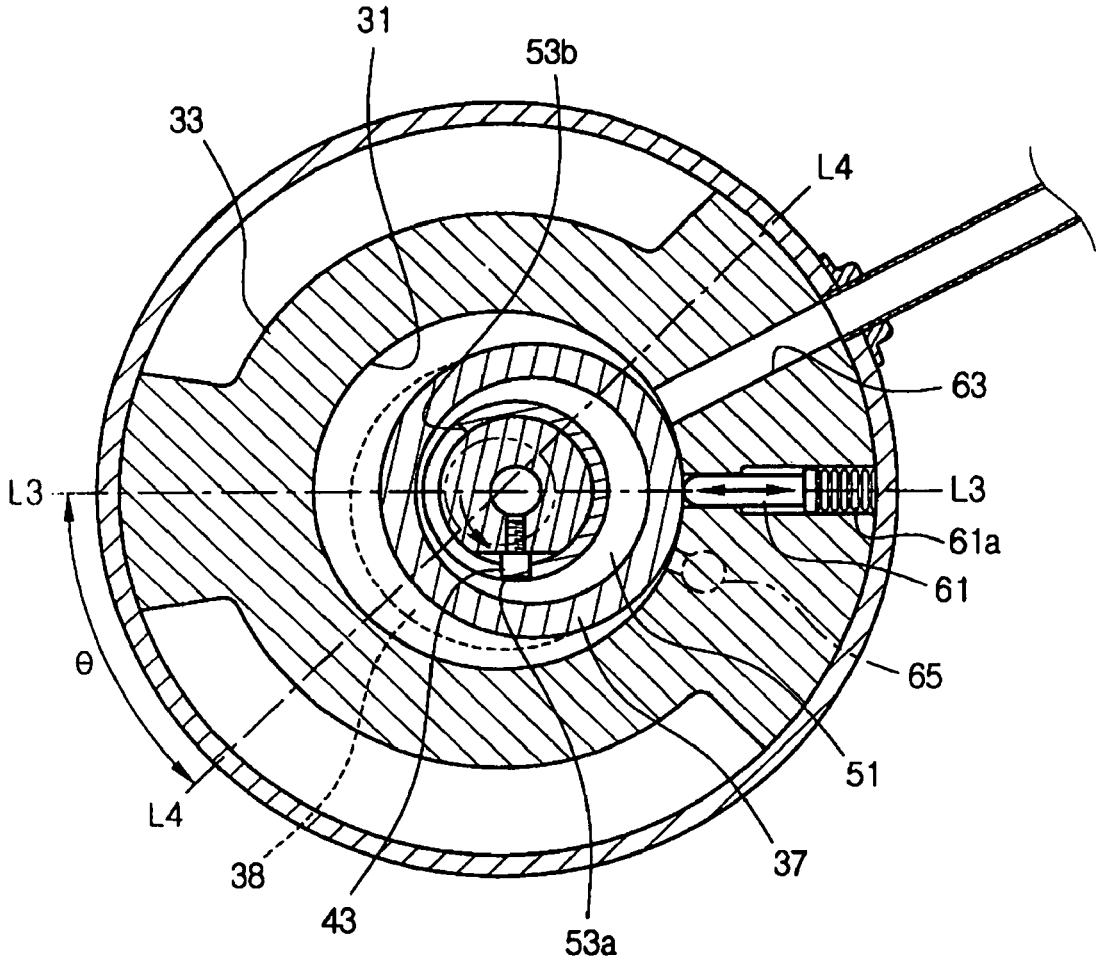
FIG. 3 is a sectional view illustrating an first compression chamber in which a compression operation is executed by the eccentric unit of FIG. 2 when the rotating shaft is rotated in a first direction.

An first vane 61 is positioned between the first inlet and outlet ports 63 and 65, and is biased in a radial direction by a first support spring 61*a* to be in close contact with the first roller 37 (see, FIG. 3). Further, a second vane 62 is positioned between the second inlet and outlet ports 64 and 66, and is biased in a radial direction by a second support spring 62*a* to be in close contact with the second roller 38 (see, FIG. 5).

Further, a refrigerant outlet pipe 69*a* extends from an accumulator 69 which contains a refrigerant therein. Of the refrigerant contained in the accumulator 69, only a gas refrigerant flows into the compressor through the refrigerant outlet pipe 69*a*. A path control unit 70 is installed at a predetermined position of the refrigerant outlet pipe 69*a*. The path control unit 70 functions to open or close an intake path 67 or 68, thus supplying the gas refrigerant to the first or second inlet port 63 or 64 of the first or second compression chamber 31 or 32 in which a compression operation is executed.

A valve unit 71 is installed in the path control unit 70 to be movable in a horizontal direction. The valve unit 71 functions to open one of the intake paths 67 and 68 by a difference in pressure between the intake path 67 connected to the first inlet port 63 and the intake path 68 connected to the second inlet port 64, thus supplying the gas refrigerant to the first inlet port 63 or second inlet port 64.

The construction of the rotating shaft 21 and the eccentric unit 40 according to the present invention will be described in the following with reference to FIG. 2.

Figure 2:
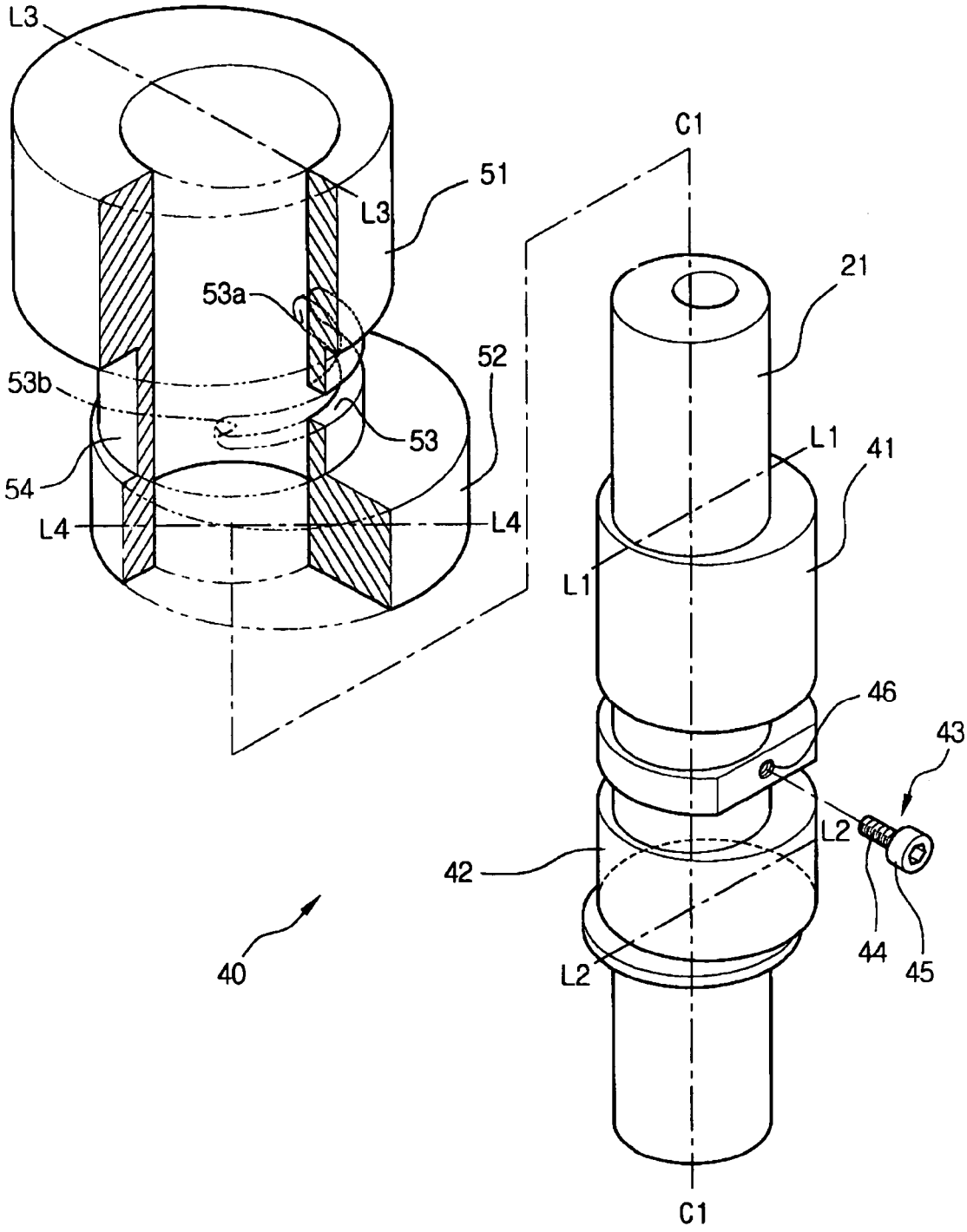
FIG. 2 is an exploded perspective view of an eccentric unit included in the compressor of FIG. 1, in which first and second eccentric bushes of the eccentric unit are separated from a rotating shaft.

FIG. 2 is an exploded perspective view of the eccentric unit included in the compressor of FIG. 1, in which first and second eccentric bushes of the eccentric unit are separated from the rotating shaft. As illustrated in FIG. 2, the eccentric unit 40 includes first and second eccentric cams 41 and 42 which are mounted to the rotating shaft 21 to be placed in the first and second compression chambers 31 and 32, respectively. First and second eccentric bushes 51 and 52 are fitted over the first and second eccentric cams 41 and 42, respectively. A locking pin 43 is installed on the rotating shaft 21 between the first and second eccentric cams 41 and 42. A slot 53 having a predetermined length is formed between the first and second eccentric bushes 51 and 52. The locking pin 43 engages with the slot 53.

The first and second eccentric cams 41 and 42 are integrally fitted over the rotating shaft 21 to be eccentric from a central axis C1—C1 of the rotating shaft 21. The first and second eccentric cams 41 and 42 are positioned to correspond a first eccentric line L1—L1 of the first eccentric cam 41 to a second eccentric line L2—L2 of the second eccentric cam 42. In this case, the first eccentric line L1—L1 is defined as a line to connect a maximum eccentric part of the first eccentric cam 41, which is maxim ally projected from the rotating shaft 21, to a minimum eccentric part of the first eccentric cam 41, which is minimally projected from the rotating shaft 21. Meanwhile, the second eccentric line L2—L2 is defined as a line to connect a maximum eccentric part of the second eccentric cam 42, which is maximally projected from the rotating shaft 21, to a minimum eccentric part of the second eccentric cam 42, which is minimally projected from the rotating shaft 21.

The locking pin 43 includes a threaded shank 44 and a head 45. The head 45 is slightly larger than the shank 44 in diameter, and is formed at an end of the shank 44. Further, a threaded hole 46 is formed on the rotating shaft 21 between the first and second eccentric cams 41 and 42 to be at about 90° with the maximum eccentric parts of the first and second eccentric cams 41 and 42. The threaded shank 44 of the locking pin 43 is inserted into the threaded hole 46 in a screw-type fastening method to lock the locking pin 43 to the rotating shaft 21.

The first and second eccentric bushes 51 and 52 are integrated with each other by a connecting part 54 which connects the first and second eccentric bushes 51 and 52 to each other. The slot 53 is formed around a part of the connecting part 54, and has a width which is slightly larger than a diameter of the head 45 of the locking pin 43.

Thus, when the first and second eccentric bushes 51 and 52 which are integrally connected to each other by the connecting part 54 are fitted over the rotating shaft 21 and the locking pin 43 is inserted to the threaded hole 46 of the rotating shaft 21 through the slot 53, the first eccentric bush 51 is rotatably fitted over the first eccentric cam 41 and the second eccentric bush 52 is rotatably fitted over the second eccentric cam 42.

When the rotating shaft 21 is rotated counterclockwise or clockwise in such a state, the first and second eccentric bushes 51 and 52 are not rotated until the locking pin 43 comes into contact with one of the first and second ends 53*a* and 53*b* of the slot 53. When the locking pin 43 comes into contact with the first or second end 53*a* or 53*b* of the slot 53, the first and second eccentric bushes 51 and 52 are rotated counterclockwise or clockwise along with the rotating shaft 21.

In this case, an eccentric line L3—L3, which connects the maximum eccentric part of the first eccentric bush 51 to the minimum eccentric part thereof, is placed at about 90° with a line which connects the first end 53*a* of the slot 53 to a center of the connecting part 54. Meanwhile, an eccentric line L4—L4, which connects the maximum eccentric part of the second eccentric bush 52 to the minimum eccentric part thereof, is placed at about 90° with a line which connects the second end 53*b* of the slot 53 to the center of the connecting part 54.

Figure 5:
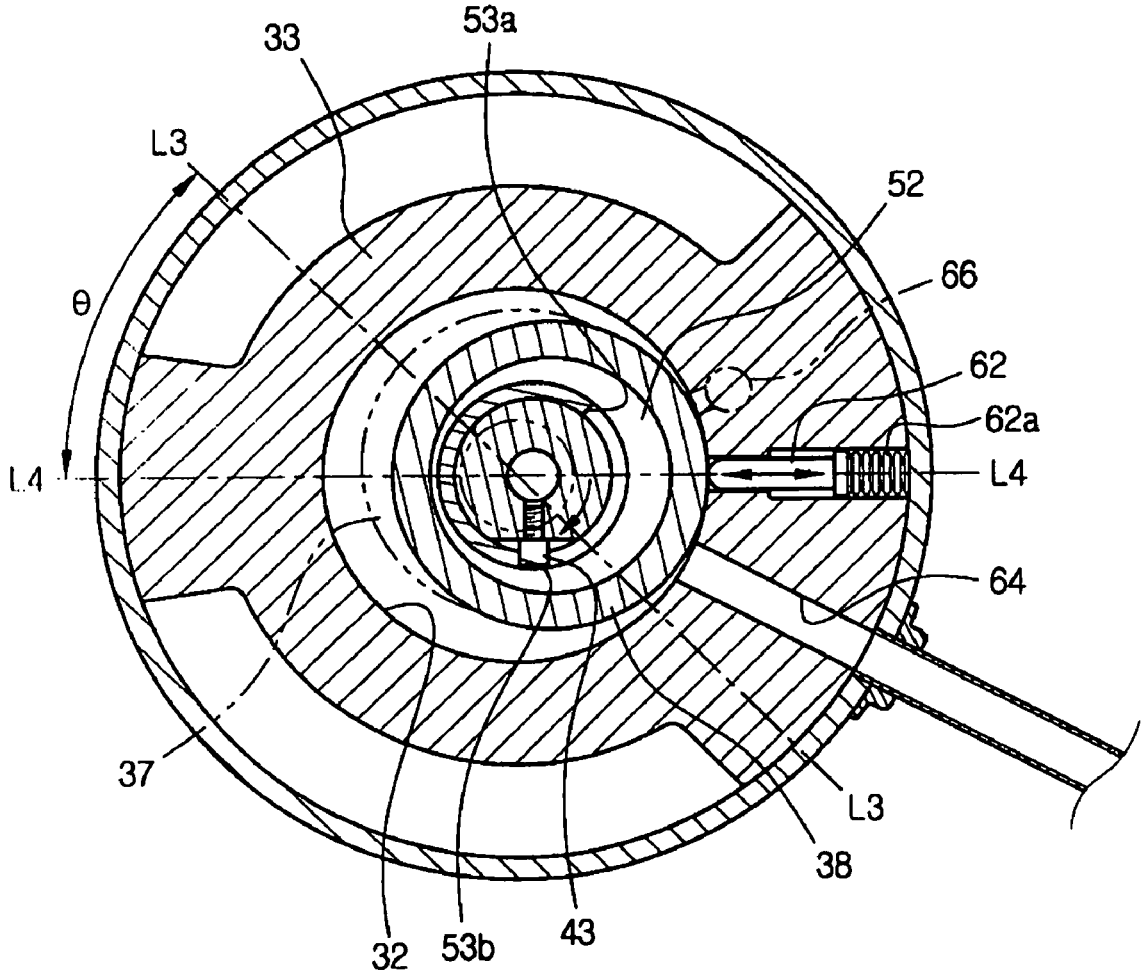
FIG. 5 is a sectional view illustrating a second compression chamber in which the compression operation is executed by the eccentric unit of FIG. 2 when the rotating shaft is rotated in a second direction.

Further, an angle between the eccentric line L3—L3 of the first eccentric bush 51 and the eccentric line L4—L4 of the second eccentric bush 52 is less than 180° (see, FIGS. 3 and 5). An angle between the center of the connecting part 54 and the first and second ends 53*a* and 53*b* of the slot 53, which is formed around a part of the connecting part 54, is equal to the angle between the eccentric lines L3—L3 and L4—L4.

In this embodiment, when the locking pin 43 is locked by the first end 53*a* of the slot 53 and the first eccentric bush 51 is rotated along with the rotating shaft 21 counterclockwise of course, the eccentric bush 52 is also rotated), the eccentric line L3—L3 of the first eccentric bush 51 corresponds to the eccentric line L1—L1 of the first eccentric cam 41, thus causing the first eccentric bush 51 to be rotated counterclockwise while being maxim ally eccentric from the rotating shaft 21. At this time, the eccentric line L4—L4 of the second eccentric bush 52 crosses the eccentric line L2—L2 of the second eccentric cam 42 at a slight angle with the eccentric line L2—L2, thus causing the second eccentric bush 52 to be rotated along with the rotating shaft 21 while being slightly eccentric from the rotating shaft 21 (see, FIG. 3).

On the contrary, when the locking pin 43 is locked by the second end 53*b* of the slot 53 and the second eccentric bush 52 is rotated along with the rotating shaft 21 clockwise, the eccentric line L4—L4 of the second eccentric bush 52 corresponds to the eccentric line L2—L2 of the second eccentric cam 42, thus causing the second eccentric bush 52 to be rotated clockwise while being maxim ally eccentric from the rotating shaft 21. At this time, the eccentric line L3—L3 of the first eccentric bush 51 crosses the eccentric line L1—L1 of the first eccentric cam 41 at a slight angle with the eccentric line L1—L1, thus causing the first eccentric bush 51 to be rotated along with the rotating shaft 21 while being slightly eccentric from the rotating shaft 21.

The operation of compressing a gas refrigerant in the first or second compression chamber by the eccentric unit, which is constructed as described above, will be described in the following with reference to FIGS. 3 to 6.

Figure 4:
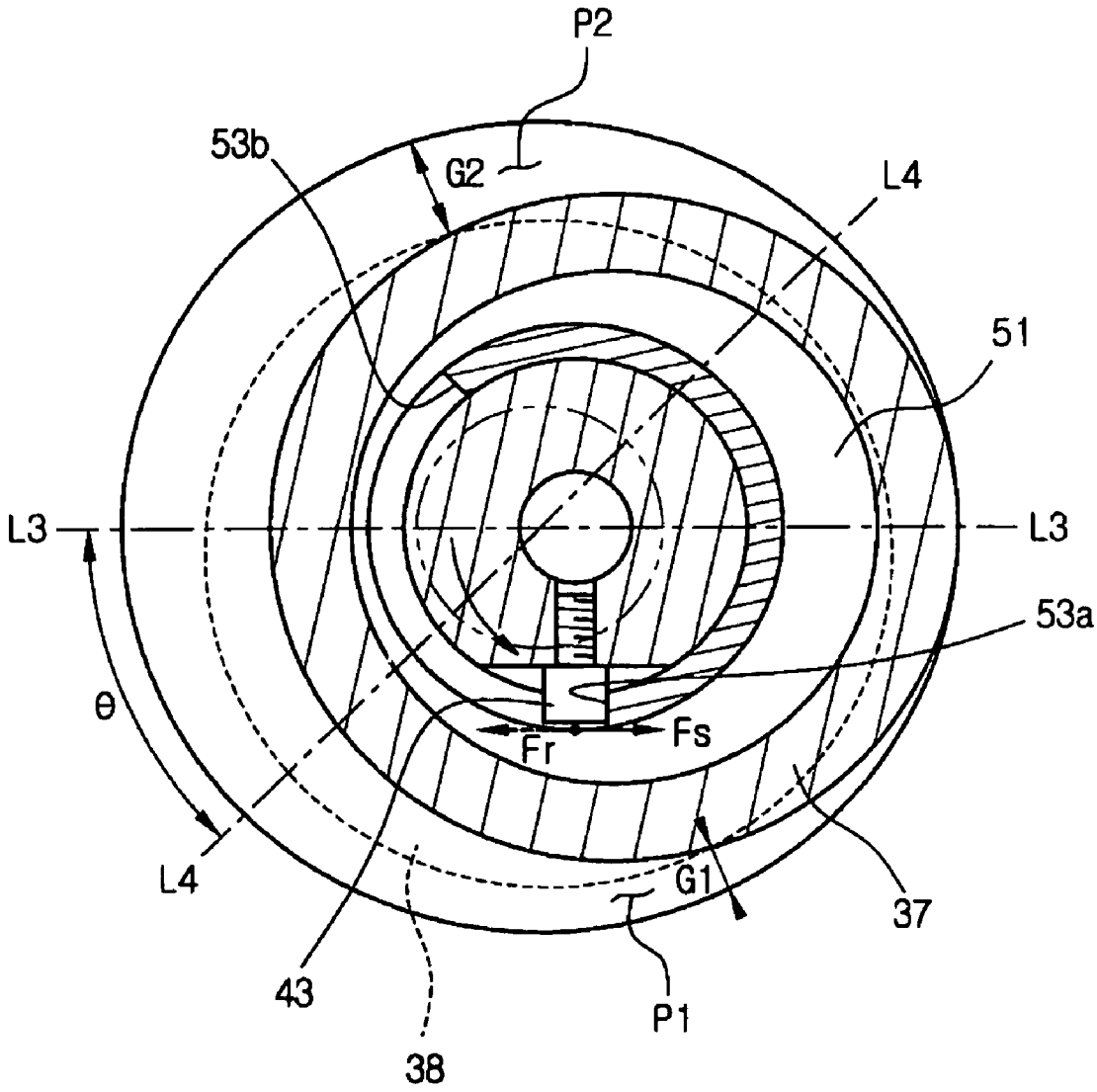
FIG. 4 is a sectional view corresponding to FIG. 3 to illustrate the first eccentric bush of the eccentric unit smoothly rotated while not being slipped over an first eccentric cam, regardless of variance in pressure in the first compression chamber.

FIG. 3 is a sectional view illustrating the first compression chamber in which the compression operation is executed by the eccentric unit of FIG. 2 when the rotating shaft is rotated in the first direction. FIG. 4 is a sectional view corresponding to FIG. 3 to illustrate the first eccentric bush of the eccentric unit smoothly rotated while not being slipped over an first eccentric cam, regardless of variance in pressure in the first compression chamber.

In FIGS. 3 and 4, the partition plate 34, which partitions the first and second compression chambers 31 and 32 into each other, is omitted to illustrate relative positions of the first and second rollers 37 and 38 which are rotated in the first and second compression chambers 31 and 32, respectively. Thus, FIGS. 3 and 4 show the first and second compression chambers 31 and 32 as if they communicated with each other. Likewise, the partition plate 34 is not shown in FIGS. 5 and 6 to illustrate relative positions of the first and second rollers 37 and 38.

As shown in FIG. 3, when the rotating shaft 21 is rotated in the first direction which is counterclockwise in FIG. 3, the locking pin 43 projected from the rotating shaft 21 is rotated at a predetermined angle while being inserted into the slot 53 which is formed on the rotating shaft 21 between the first and second eccentric bushes 51 and 52. At this time, the locking pin 43 is locked by the first end 53*a* of the slot 53, thus causing the first and second eccentric bushes 51 and 52 to be rotated along with the rotating shaft 21.

As described above, when the locking pin 43 is locked by the first end 53*a* of the slot 53, the eccentric line L3—L3 of the first eccentric bush 51 corresponds to the eccentric line L1—L1 of the first eccentric cam 41, thus the first eccentric bush 51 is rotated while being maxim ally eccentric from the central axis C1—C1 of the rotating shaft 21. At this time, the first roller 37 is rotated while being in contact with an inner surface of the housing 33 defining the first compression chamber 31, thus executing the compression operation.

On the other hand, the second eccentric bush 52 is moved to a position where the eccentric line L4—L4 of the second eccentric bush 52 is at a predetermined angle θ with the eccentric line L2—L2 of the second eccentric cam 42 or the eccentric line L3—L3 of the first eccentric bush 51, thus the second eccentric bush 52 is rotated while being slightly eccentric from the central axis C1—C1 of the rotating shaft 21. At this time, the second roller 38 is rotated while being spaced apart from the inner surface of the housing 33 defining the second compression chamber 32, thus causing the compression operation to be rarely executed in the second compression chamber 32.

Therefore, when the rotating shaft 21 is rotated in the first direction, the gas refrigerant flowing to the first compression chamber 31 through the first inlet port 63 is compressed by the first roller 37 in the first compression chamber 31 having a larger capacity, and subsequently is discharged from the first compression chamber 31 through the first outlet port 65. On the other hand, the compression operation is not executed in the second compression chamber 32 having a smaller capacity. Therefore, the rotary compressor is operated in a larger capacity compression mode.

Meanwhile, as shown in FIG. 3, when the first roller 37 comes into contact with the first vane 61, the operation of compressing the gas refrigerant is completed and an operation of sucking the gas refrigerant is started. At this time, some of the compressed gas, which was not discharged from the first compression chamber 31 through the first outlet port 65, returns to the first compression chamber 31 and is expanded again, thus applying a pressure to the first roller 37 and the first eccentric bush 51 in a rotating direction of the rotating shaft 21. At this time, the first eccentric bush 51 is rotated at a speed faster than the rotating shaft 21, thus causing the first eccentric bush 51 to slip over the first eccentric cam 41.

When the rotating shaft 21 is further rotated in such a state, the locking pin 43 collides with the first end 53*a* of the slot 53 to rotate the first eccentric bush 51 at a similar speed as that of the rotating shaft 21. At this time, noise may be generated and the locking pin 43 and the slot 53 may be damaged, due to the collision between the locking pin 43 and the slot 53.

However, according to the present invention, the eccentric unit 40 is designed such that the eccentric line L3—L3 of the first eccentric bush 51 extends at the predetermined angle θ with the eccentric line L4—L4 of the second eccentric bush 52. Therefore, even when the second roller 38 does not execute the compression operation, the second roller 38 is rotated in the second compression chamber 32 while being slightly eccentric from the rotating shaft 21, thus allowing the first eccentric bush 51 to be rotated at a same speed as that of the rotating shaft 21 without slippage.

That is, as shown in FIG. 4, when the first roller 37 comes into contact with the first vane 61, some of the gas refrigerant returns to the first compression chamber 31 through the first outlet port 65 and is expanded again, thus generating a force $F_s$. The force $F_s$ acts on the first eccentric bush 51 in the rotating direction of the rotating shaft 21 which is the first direction, thus the first eccentric bush 51 slips over the first eccentric cam 41. However, since the second eccentric bush 52 is rotated in the second compression chamber 32 while being slightly eccentric from the rotating shaft 21, a gap G1 defined between the second roller 38 and the inner surface of the housing 33 at a position which is adjacent to the second vane 62 is smaller than a gap G2 defined between the second roller 38 and the inner surface of the housing 33 at a position which is opposite to the second vane 62. Thus, a gas pressure P1 around the gap G1 is larger than a gas pressure P2 around the gap G2, thereby a force $F_r$ acts on the second eccentric bush 52 in a direction, which is opposite to the first direction.

As a result, when the eccentric angle θ is determined to make the force $F_r$, which resists a rotation and acts on the second eccentric bush 52, be equal to the force $F_s$, which causes the first eccentric bush 51 to slip over the first eccentric cam 41, the force $F_s$ is offset by the force $F_r$, thus allowing the first eccentric bush 51 to be rotated at the same speed as that of the rotating shaft 21 without slipping over the first eccentric cam 41.

Figure 6:
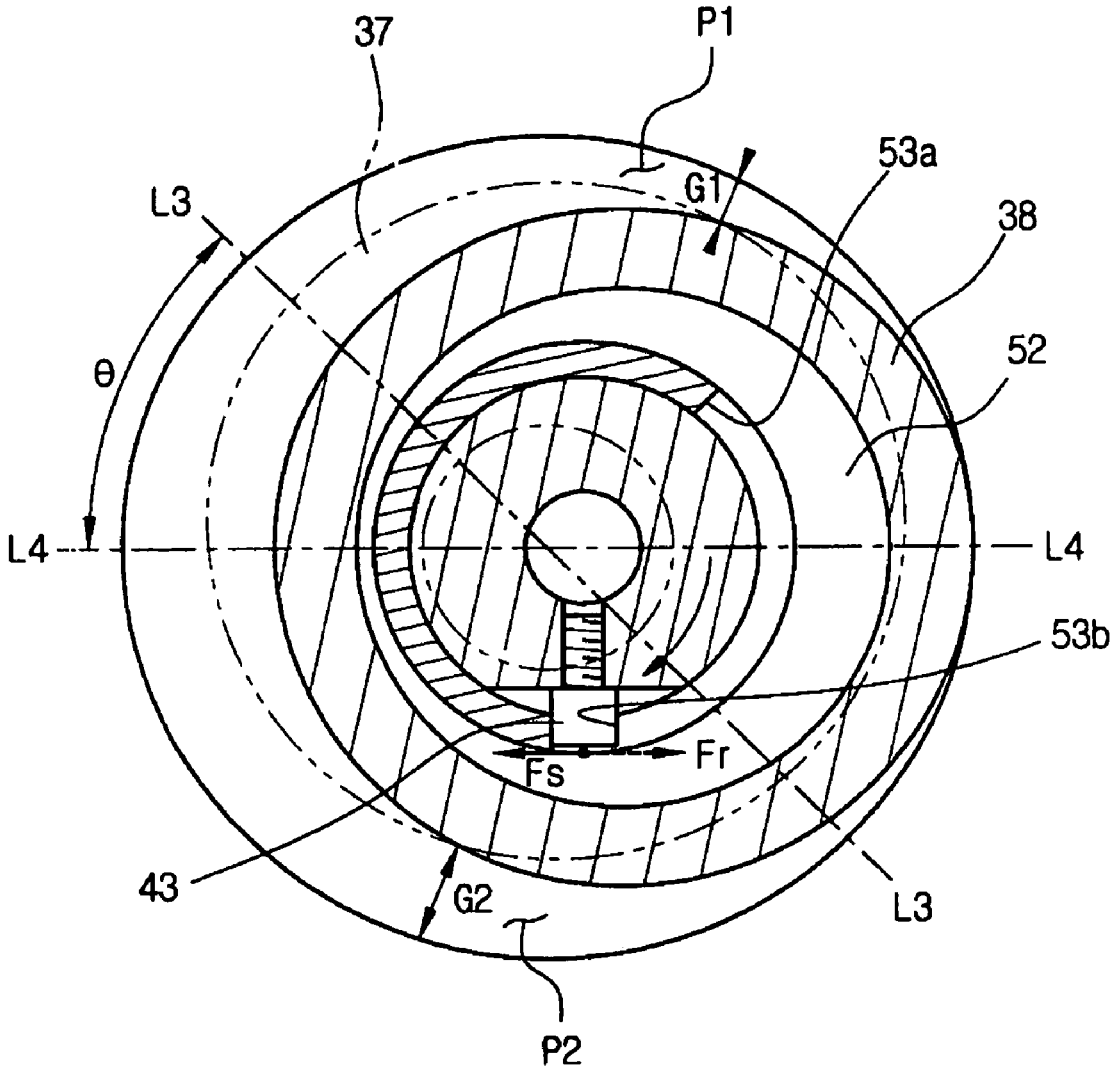
FIG. 6 is a sectional view corresponding to FIG. 5 to illustrate the second eccentric bush of the eccentric unit smoothly rotated while not being slipped over a second eccentric cam, regardless of variance in pressure in the second compression chamber.

FIG. 5 is a sectional view illustrating the second compression chamber in which the compression operation is executed by the eccentric unit of FIG. 2 when the rotating shaft is rotated in the second direction. FIG. 6 is a sectional view corresponding to FIG. 5 to illustrate the second eccentric bush of the eccentric unit smoothly rotated while not being slipped over the second eccentric cam, regardless of variance in pressure in the second compression chamber.

As illustrated in FIG. 5, when the rotating shaft 21 is rotated in the second direction which is clockwise in FIG. 5, the compressor is operated oppositely to the operation shown in FIGS. 3 and 4, thus causing the compression operation to be executed in only the second compression chamber 32.

That is, while the rotating shaft 21 is rotated in the second direction, the locking pin 43 projected from the rotating shaft 21 comes into contact with the second end 53*b* of the slot 53, thus causing the second and first eccentric bushes 52 and 51 to be rotated in the second direction.

In this case, the eccentric line L4—L4 of the second eccentric bush 52 corresponds to the eccentric line L2—L2 of the second eccentric cam 42, thus the second eccentric bush 52 is rotated while being maxim ally eccentric from the central axis C1—C1 of the rotating shaft 21. At this time, the second roller 38 is rotated while being in contact with the inner surface of the housing 33 defining the second compression chamber 32, thus executing the compression operation.

On the other hand, the first eccentric bush 51 is moved to a position where the eccentric line L3—L3 of the first eccentric bush 51 is at the predetermined angle θ with the eccentric line L1—L1 of the first eccentric cam 41 or the eccentric line L4—L4 of the second eccentric bush 52, thus the first eccentric bush 51 is rotated while being slightly eccentric from the central axis C1—C1 of the rotating shaft 21. At this time, the first roller 37 is rotated while being spaced apart from the inner surface of the housing 33 defining the first compression chamber 31, thus causing the compression operation to be rarely executed in the first compression chamber 31.

Therefore, the gas refrigerant flows to the second compression chamber 32 having a smaller capacity through the second inlet port 64, and is compressed by the second roller 38 prior to discharging from the second compression chamber 32 through the second outlet port 66. On the contrary, the compression operation is not executed in the first compression chamber 31 having a larger capacity. Therefore, the rotary compressor is operated in a smaller capacity compression mode.

Meanwhile, as shown in FIG. 5, when the second roller 38 comes into contact with the second vane 62, the operation of compressing the gas refrigerant is completed and the operation of sucking the gas refrigerant is started. At this time, some of the compressed gas, which is not discharged from the second compression chamber 32 through the second outlet port 66, returns to the second compression chamber 32 and is expanded again, thus applying a pressure to the second roller 38 and the second eccentric bush 52 in the rotating direction of the rotating shaft 21. At this time, the second eccentric bush 52 is momentarily rotated at a speed faster than the rotating shaft 21, thus causing the second eccentric bush 52 to slip over the second eccentric cam 42.

When the rotating shaft 21 is further rotated in such a state, the locking pin 43 collides with the second end 53*b* of the slot 53 again to make the second eccentric bush 52 be rotated at a same speed as that of the rotating shaft 21. In this case, noise may be generated and the locking pin 43 and the slot 53 may be damaged, due to the collision between the locking pin 43 and the slot 53. However, the slippage and collision do not occur when the rotating shaft 21 is rotated in the second direction, in the same manner as when the rotating shaft 21 is rotated in the first direction.

That is, as shown in FIG. 6, when the second roller 38 comes into contact with the second vane 62, some of the gas refrigerant returns to the second compression chamber 32 through the second outlet port 66 and is expanded again, thus generating a force $F_s$. The force $F_s$ acts on the second eccentric bush 52 in the rotating direction of the rotating shaft 21 which is the second direction, thus the second eccentric bush 52 slips over the second eccentric cam 42. However, since the first eccentric bush 51 is rotated in the first compression chamber 31 while being slightly eccentric from the rotating shaft 21, a gap G1 defined between the first roller 37 and the inner surface of the housing 33 at a position which is adjacent to the first or second vane 61 or 62 is smaller than a gap G2 defined between the first roller 37 and the inner surface of the housing 33 at a position which is opposite to the second vane 62. Thus, a gas pressure P1 around the gap G1 is larger than a gas pressure P2 around the gap G2, thereby a force $F_r$ acts on the first eccentric bush 51 in a direction, which is opposite to the second direction.

As a result, when the eccentric angle θ is determined to make the force $F_r$, which resists a rotation and acts on the first eccentric bush 51, be equal to the force $F_s$, which causes the second eccentric bush 52 to slip over the second eccentric cam 42, the force $F_s$ is offset by the force $F_r$, thus allowing the second eccentric bush 52 to be rotated at the same speed as that of the rotating shaft 21 without slipping over the second eccentric cam 42.

The present invention provides a variable capacity rotary compressor, which is capable of varying a compression capacity as desired by an eccentric unit which is rotated counterclockwise or clockwise in first and second compression chambers having different capacities.

The present invention provides a variable capacity rotary compressor, which is designed to make an angle between eccentric lines of first and second eccentric bushes be less than 180°, thus providing rotating resistance to an eccentric bush executing a compression operation by an eccentric bush which does not execute the compression operation, therefore preventing the first and second eccentric bushes from slipping due to variance in pressure in an first or second compression chamber when an eccentric unit is rotated counterclockwise or clockwise and thereby allowing the first and second eccentric bushes to be smoothly rotated.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, comprising:

first and second compression chambers having different capacities;

a rotating shaft passing through the first and second compression chambers;

first and second eccentric cams eccentrically mounted to the rotating shaft to be placed in the first and second compression chambers, respectively;

first and second eccentric bushes fitted over the first and second eccentric cams, respectively, to cause an eccentric line of the first eccentric bush to cross an eccentric line of the second eccentric bush; and a locking pin to change a position of the first or second eccentric bush to a maximum eccentric position, according to a rotating direction of the rotating shaft, wherein an angle between a maximum eccentric part of the first eccentric bush and a maximum eccentric part of the second eccentric bush is less than 180° in a rotating direction of the first or second eccentric bush which executes a compression operation, wherein the locking pin is positioned between the first and second eccentric cams, which are eccentric in a same direction, and the first and second eccentric bushes are integrated with each other by a connecting part, which connects the first and second eccentric bushes to each other, with a slot of a predetermined length being formed around the connecting part, and the locking pin coming into contact with a first end or a second end of the slot while the rotating shaft is rotated as the locking pin is inserted into the slot, to cause the first and second eccentric bushes to be rotated as the position of either of the first and second eccentric bushes is changed to the maximum eccentric position with respect to the rotating shaft.

2. The rotary compressor according to claim 1, wherein the locking pin comprises:

a threaded shank; and a head, having a larger diameter than the shank, formed at an end of the shank wherein the head being projected from the rotating shaft in a radial direction when the shank of the locking pin is inserted into a hole which is formed on the rotating shaft at a position which is spaced apart from a maximum eccentric part of each of the first and second eccentric cams, at about 90°.

3. The rotary compressor according to claim 2, wherein the slot has an arc shape with an angle of less than 180° formed between a line extending from the first end of the slot to a center of the rotating shaft and a line extending from the second end of the slot to the center of the rotating shaft.

4. The rotary compressor according to claim 3, wherein the first end of the slot is positioned to follow the maximum eccentric part of the first eccentric bush at about 90° when the rotating shaft is rotated in a first direction, and the second end of the slot is positioned to lead the maximum eccentric part of the second eccentric bush at about 90° when the rotating shaft is rotated in a second direction, to cause the position of the first or second eccentric bush to be changed to the maximum eccentric position, when the rotating shaft is rotated in the first or second direction with the locking pin coming into contact with the first end or the second end of the slot and the eccentric lines of the first and second eccentric bushes crossing each other.

5. The rotary compressor according to claim 4, wherein, when the rotating shaft is rotated in the first direction to cause the locking pin to be in contact with the first end of the slot, a position of the maximum eccentric part of the first eccentric bush is changed to the maximum eccentric position where the maximum eccentric part of the first eccentric bush corresponds to the maximum eccentric part of the first eccentric cam, to cause a compression operation to be executed in the first compression chamber, and a position of the maximum eccentric part of the second eccentric bush is changed to a minimum eccentric position where the maximum eccentric part of the second eccentric bush is adjacent to a minimum eccentric part of the second eccentric cam, thus preventing a compression operation from being executed in the second compression chamber.

6. The rotary compressor according to claim 5, wherein, when the maximum eccentric part of the first eccentric bush passes an outlet port of the first compression chamber, a rotating resistance acts on the second eccentric bush in a direction opposite to a rotating direction of the rotating shaft due to a difference in pressure between an inside portion of the second compression chamber, where the eccentric line of the second eccentric bush extends about 180° or less relative to the eccentric line of the first eccentric bush, and an outside portion of the second compression chamber opposite to the inside portion, thus preventing the first eccentric bush from being rotated at a speed faster than the rotating shaft, therefore preventing the first eccentric bush from slipping.

7. The rotary compressor according to claim 4, wherein, when the rotating shaft is rotated in the second direction to cause the locking pin to be in contact with the second end of the slot, a position of the maximum eccentric part of the second eccentric bush is changed to the maximum eccentric position where the maximum eccentric part of the second eccentric bush corresponds to a maximum eccentric part of the second eccentric cam, to cause a compression operation to be executed in the second compression chamber, and a position of the maximum eccentric part of the first eccentric bush is changed to a minimum eccentric position where the maximum eccentric part of the first eccentric bush is adjacent to a minimum eccentric part of the first eccentric cam, thus preventing a compression operation from being executed in the first compression chamber.

8. The rotary compressor according to claim 7, wherein, when the maximum eccentric part of the second eccentric bush passes an outlet port of the second compression chamber, a rotating resistance acts on the first eccentric bush in a direction opposite to a rotating direction of the rotating shaft due to a difference in pressure between an inside portion of the first compression chamber, where the eccentric line of the first eccentric bush extends about 180° or less relative to the eccentric line of the second eccentric bush, and an outside portion of the first compression chamber opposite to the inside portion, thus preventing the second eccentric bush from being rotated at a speed faster than the rotating shaft, therefore preventing the second eccentric bush from slipping.

9. A variable capacity rotary compressor, comprising:

first and second compression chambers having different capacities, in which compression operations are carried out;

a rotating shaft, passing through the first and second compression chambers, to rotate in first and second directions;

first and second eccentric cams mounted to the rotating shaft in the first and second compression chambers, respectively;

first and second eccentric bushes, each including a maximum eccentric part, fitted over the first and second eccentric cams, respectively, to be eccentric in opposite directions with respect to the rotating shaft, with an angle between the maximum eccentric parts being less than 180°;

first and second rollers fitted over the first and second eccentric bushes to be rotated along inner surfaces of the first and second compression chambers, to thereby compress a gas flowing into the first and second compression chambers, respectively; and a locking pin to change a position of the first or second eccentric bush to a maximum eccentric position, according to one of the rotating directions of the rotating shaft, wherein the locking pin is positioned between the first and second eccentric cams, wherein the first and second eccentric bushes are integrated with each other by a connecting part which connects the first and second eccentric bushes to each other, and wherein the connecting part comprises a slot, including first and seconds ends, having a predetermined length, formed around the connecting part.

10. The rotary compressor according to claim 9, wherein the locking pin contacts one of the first and the second end of the slot while the rotating shaft is rotated, and thereby the first and second eccentric bushes are rotated as the position of either of the first and second eccentric bushes is changed to the maximum eccentric position with respect to the rotating shaft.

11. The rotary compressor according to claim 10, wherein the locking pin comprises:

a threaded shank; and a head, having a larger diameter than the shank and formed at an end of the shank, to be projected from the rotating shaft in a radial direction.

12. The rotary compressor according to claim 11, wherein the shank of the locking pin is inserted into a hole which is formed on the rotating shaft at a position which is substantially 90° from the maximum eccentric part of each of the first and second eccentric cams.

13. The rotary compressor according to claim 12, wherein the slot extends less than 180° around the rotating shaft.

14. The rotary compressor according to claim 13, wherein the first end is positioned to follow the maximum eccentric part of the first eccentric bush at substantially 90° when the rotating shaft is rotated in a first direction.

15. The rotary compressor according to claim 14, wherein the second end of the slot is positioned to lead the maximum eccentric part of the second eccentric bush at substantially 90° when the rotating shaft is rotated in a second direction.

16. The rotary compressor according to claim 15, wherein, when the rotating shaft is rotated in the first direction, a position of the maximum eccentric part of the first eccentric bush is changed to the maximum eccentric position where the maximum eccentric part of the first eccentric bush corresponds to the maximum eccentric part of the first eccentric cam.

17. The rotary compressor according to claim 16, wherein when the rotating shaft is rotated in the first direction, a position of the maximum eccentric part of the second eccentric bush is changed to a minimum eccentric position where the maximum eccentric part of the second eccentric bush is adjacent to a minimum eccentric part of the second eccentric cam.

18. The rotary compressor according to claim 17, further comprising an outlet port of the first compression chamber, wherein, when the maximum eccentric part of the first eccentric bush passes the outlet port, a rotating resistance acts on the second eccentric bush in a direction opposite to a rotating direction of the rotating shaft due to a difference in pressure between an inside portion and an outside portion of the second compression chamber.

19. The rotary compressor according to claim 18, wherein when the rotating shaft is rotated in the second direction, a position of the maximum eccentric part of the first eccentric bush is changed to a minimum eccentric position where the maximum eccentric part of the first eccentric bush is adjacent to a minimum eccentric part of the first eccentric cam.

20. The rotary compressor according to claim 15, wherein, when the rotating shaft is rotated in the second direction, a position of the maximum eccentric part of the second eccentric bush is changed to the maximum eccentric position where the maximum eccentric part of the second eccentric bush corresponds to the maximum eccentric part of the second eccentric cam.

21. The rotary compressor according to claim 20, further comprising an outlet port of the second compression chamber, wherein, when the maximum eccentric part of the second eccentric bush passes the outlet port, a rotating resistance acts on the first eccentric bush in a direction opposite to a rotating direction of the rotating shaft due to a difference in pressure between an inside portion and an outside portion of the first compression chamber.

* * * * *

UNITED STATES PATENT AND TRADEMARK OFFICE

CERTIFICATE OF CORRECTION

PATENT NO. : 7,150,602 B2
APPLICATION NO. : 10/815661
DATED : December 19, 2006
INVENTOR(S) : Jin Kyu Choi et al.

It is certified that error appears in the above-identified patent and that said Letters Patent is hereby corrected as shown below:

On Title Page, Item (57) (Abstract), Line 8, after “bushes” insert --to--.

Column 13, Line 39, change “seconds” to --second--.

Signed and Sealed this

Twenty-seventh Day of March, 2007

JON W. DUDAS
*Director of the United States Patent and Trademark Office*